US010625891B2

(12) United States Patent
Fukeda et al.

(10) Patent No.: US 10,625,891 B2
(45) Date of Patent: Apr. 21, 2020

(54) BAG SUPPLY DEVICE

(71) Applicant: Toyo Jidoki Co., Ltd., Minato-ku, Tokyo (JP)

(72) Inventors: Shinichi Fukeda, Iwakuni (JP); Tetsuaki Yomoda, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 25 days.

(21) Appl. No.: 15/722,843

(22) Filed: Oct. 2, 2017

(65) Prior Publication Data

US 2018/0093787 A1 Apr. 5, 2018

(30) Foreign Application Priority Data

Oct. 4, 2016 (JP) ..... 2016-196303
Jun. 27, 2017 (JP) ..... 2017-125218

(51) Int. Cl.
*B65B 43/46* (2006.01)
*B65B 43/44* (2006.01)
(Continued)

(52) U.S. Cl.
CPC ..... *B65B 43/465* (2013.01); *B65B 43/16* (2013.01); *B65B 43/44* (2013.01); *B65B 43/50* (2013.01);
(Continued)

(58) Field of Classification Search
CPC ..... B65B 5/045; B65B 43/16; B65B 43/30; B65B 43/44; B65B 43/50; B65B 43/465;
(Continued)

(56) References Cited

U.S. PATENT DOCUMENTS 4,078,358 A * 3/1978 Henderson ..... B65B 39/08 53/459
4,182,094 A * 1/1980 Lieder ..... B65B 43/18 271/227
(Continued)

FOREIGN PATENT DOCUMENTS

JP 04006021 A * 1/1992
JP H7-5125 1/1995
(Continued)

*Primary Examiner* — Gene O Crawford
*Assistant Examiner* — Kelvin L Randall, Jr.
(74) *Attorney, Agent, or Firm* — Norton Rose Fulbright US LLP

(57) ABSTRACT

A bag supply device used in a rotary bag-filling packaging machine and including: an empty-bag holding member for holding a bag, a reciprocating mechanism for moving the empty-bag holding member back and forth between a bag receiving position and a bag delivery position, a first turning mechanism for turning the empty-bag holding member around a first axis parallel to a bag width direction thereof upon operation of the reciprocating mechanism and orienting the holding face of the empty-bag holding member vertically in the delivery position, and a second turning mechanism for turning the empty-bag holding member around a second axis parallel to a bag length direction thereof and causing the bag held by the empty-bag holding member in the delivery position to be directly across from the pair of grippers stopped in the empty bag supply position.

9 Claims, 7 Drawing Sheets

(51) Int. Cl.

| | |
|---|---|
| ***B65B 43/50*** | (2006.01) |
| ***B65H 5/10*** | (2006.01) |
| ***B65B 43/16*** | (2006.01) |
| ***B65H 5/14*** | (2006.01) |
| ***B65H 3/08*** | (2006.01) |

(52) U.S. Cl.
CPC ..... *B65H 3/0833* (2013.01); *B65H 5/10* (2013.01); *B65H 5/14* (2013.01); *B65H 2403/53* (2013.01); *B65H 2701/191* (2013.01); *B65H 2801/81* (2013.01)

(58) Field of Classification Search
CPC ..... B65H 3/0833; B65H 5/10; B65H 5/14; B65H 2403/53; B65H 2701/191; B65H 2801/81
See application file for complete search history.

(56) References Cited

U.S. PATENT DOCUMENTS 4,211,053 A * 7/1980 Niccolls ..... B65B 43/18 53/386.1
6,547,107 B2 * 4/2003 Hiramoto ..... B65B 3/32 222/309
6,651,407 B2 * 11/2003 Hiramoto ..... B65B 43/16 53/386.1
7,882,685 B2 * 2/2011 Koga ..... B65B 43/465 53/570
8,122,692 B2 * 2/2012 Inoue ..... B65B 43/14 53/492
8,670,860 B2 * 3/2014 Gifford ..... B65B 43/465 700/218
2013/0343857 A1 * 12/2013 Yoshikane ..... B65B 43/14 414/798.9
2014/0083061 A1 * 3/2014 Ibaraki ..... B65B 3/02 53/558

FOREIGN PATENT DOCUMENTS

| | | |
|---|---|---|
| JP | 3123709 U | 7/2006 |
| JP | 5044844 | 10/2012 |
| JP | 2014-999 | 1/2014 |

* cited by examiner

BAG SUPPLY DEVICE

BACKGROUND OF THE INVENTION

1. Field of the Invention

The present invention relates to a bag supply device that is applied to a rotary bag-filling packaging machine that includes a plurality of pairs of intermittently rotating grippers and more particularly to a bag supply device which is applied when an empty bag magazine device is not directly across from the pair of grippers stopped at an empty bag supply position.

2. Description of the Related Art

Japanese Patent Application Publication (Kokoku) No. H7-5125 (called "Patent Document 1") discloses a bag supply device applied to a rotary bag-filling packaging machine that has a plurality of pairs of intermittently rotating grippers. This bag supply device (the reference numbers and letters given in parentheses below are those used in Patent Document 1) is disposed between an empty bag magazine device (A) that holds numerous empty bags and a pair of grippers stopped at an empty bag supply position, and it receives empty bags picked up one at a time from the empty bag magazine device (A) by a suction cup (B). The bag supply device thus provided conveys the bag toward the pair of grippers stopped at the empty bag supply position, converts the empty bag from a substantially horizontal orientation to a substantially vertical orientation in the course of this conveyance, and then delivers the bag to the pair of grippers.

More specifically, the bag supply device disclosed in Patent Document 1 comprises a support member (4), a clamping member (2) that is installed at one end of the support member (4), a shaft (9) that is installed horizontally on a stationary frame (7) and is linked to a drive source so as to be rotated reciprocally, a swing arm (3) that is fixed to the shaft (9) and swings over a specific angle range (θ1) in a vertical plane, and a linking rod (5) that links the other end of the support member (4) to the stationary frame (7). The above-described support member (4) is rotatably attached at the middle part thereof to an end portion of the swing arm (3), and its rotational axis is set to be horizontal and perpendicular to the vertical plane. A drive mechanism (including an air cylinder as a drive source) for opening and closing the clamping member (2) is installed on the support member (4).

In the bag supply device disclosed in Patent Document 1, as the swing arm (3) swings, the clamping member (2) makes a reciprocal motion between the receiving position (the position where the clamping member (2) receives an empty bag from the suction cup (B)) and the delivery position (the position where the clamping member (2) delivers the empty bag to a pair of grippers stopped at the empty bag supply position). The support member (4) is linked, at its other end, to the stationary frame (7) by the linking rod (5); accordingly, in the course of the clamping member (2) moving from the receiving position to the delivery position, the clamping member (2) turns around the rotational axis, and the clamping face of the clamping member (2) and the empty bag clamped by the clamping member (2) are converted from a substantially horizontal orientation to a substantially vertical orientation. Since the support member (4) is directly attached to the swing arm (3) that swings in the vertical plane, and its rotational axis is horizontal and perpendicular to the vertical plane, the center line passing through the center of the clamping member (2) and the empty bag in the width direction moves substantially within one vertical plane.

In Patent Document 1, a pair of grippers stopped at the empty bag supply position are disposed symmetrically with respect to one vertical plane (hereinafter this vertical plane will be referred to as a "plane of symmetry"), empty bags are stored in the empty bag magazine device so that the center line passing through the center of each of the bags in the width direction is located within the plane of symmetry, and this center line is located substantially within the plane of symmetry even while the bag is being conveyed by the bag supply device from the receiving position to the delivery position. When the empty bag magazine device and a pair of grippers stopped at the empty bag supply position are disposed in the above relation with respect to the plane of symmetry, the empty bag magazine device (and empty bags) is, in the present specification, called to be "directly across from" the pair of grippers stopped at the bag supply position.

The bag supply device disclosed in Patent Document 1 is applied when the empty bag magazine device (and empty bags) is directly across from the pair of grippers stopped at the empty bag supply position.

Nevertheless, in some cases, the empty bag magazine device are unable to be located directly across from the pair of grippers stopped at the empty bag supply position due to the layout of the rotary bag-filling packaging machine and peripheral devices or due to downsizing of the rotary bag-filling packaging machine. In such cases, the plane of symmetry of the pair of grippers stopped at the empty bag supply position and the vertical plane including the center line passing through the center in the width direction of the empty bags stored in the empty bag magazine device intersect at a specific angle (see the angle θ shown in FIG. 1). Thus, as is clear from FIG. 1, the width direction of the empty bags is not perpendicular to the plane of symmetry.

If the empty bag magazine device is not directly across from the pair of grippers stopped at the empty bag supply position, an empty bag taken out of the empty bag magazine device must be located directly across from the pair of grippers stopped at the empty bag supply position (in other words, the center of the empty bags in the width direction must be located in the plane of symmetry of the pair of grippers, and the width direction of the empty bags must be perpendicular to the plane of symmetry) during the period that the empty bags are being conveyed from the receiving position to the delivery position.

Japanese Patent No. 5,044,844 (called "Patent Document 2") discloses a bag supply device that can be applied when an empty bag magazine device is not directly across from a pair of grippers stopped at an empty bag supply position.

The bag supply device disclosed in Patent Document 2 (the numbers and letters given in parentheses below are those used in Patent Document 2) includes a turning arm (14), which is provided with a suction cup (15) at its distal end and swings up and down, and a holder (40), which is provided with a pair of clamping pieces (45) and moves in a horizontal plane. As shown in FIG. 10 of Patent Document 2, when the distal end of an empty bag positioned at a specific location in the empty bag magazine device (6) is picked up and lifted by a suction cup (8) (delivery position (x)), the empty bag is held by suction by the suction cup (15), then the turning arm (14) turns upward and the empty bag is moved to a relay position (y), and during this process the empty bag is converted to a substantially vertical orientation. The empty bag is delivered from the suction cup (8)

to the pair of clamping pieces (45) at this relay position (y) (at this point, the empty bag is not directly across from the pair of grippers (g) of the bag-filling packaging machine (see FIG. 8 of Patent Document 2)), the holder (40) and the pair of clamping pieces (45) are then turned in the horizontal plane, and the empty bag is moved to a bag conveyance destination (z) and, in this process, comes to be located directly across from the pair of grippers (g) of the bag-filling packaging machine, then the bag is gripped at both edges thereof by the grippers (g).

In the bag supply device disclosed in Patent Document 2, the mechanism (the swing arm (14), suction cup (15), etc.) for converting a bag from a substantially horizontal orientation to a substantially vertical orientation is provided separately from the mechanism (holder (40), pair of clamping pieces (45), etc.) for moving a bag in a horizontal plane and making it in an orientation that is directly across from the grippers (g). The conveyance of empty bags by these mechanisms is carried out from the delivery position (x), to the relay position (y), and then to the bag conveyance destination (z). As a result, it is difficult to improve the efficiency to convey the empty bags (or to improve the productivity of the bag-filling packaging machine). Further, since the delivery of bags made by the two mechanisms (in other words delivery made by the suction cup (15) and the pair of clamping pieces (45)) is performed at the relay position (y), it is very likely that the empty bags will be misaligned or not received. Furthermore, since the two mechanisms require independent drive sources, the overall structure of the bag supply device is complicated.

Japanese Utility Model Registration No. 3,123,709 (called "Patent Document 3") discloses a bag supply device; and in this bag supply device of Patent Document 3 as well, as is similar to the bag supply device of Patent Document 2, a mechanism (first conveyor (50)) for converting a bag taken out of an empty bag magazine device (14) from a substantially horizontal orientation to a substantially vertical orientation and a mechanism (second conveyor 60) for turning a bag in the horizontal plane and putting it directly across from a pair of grippers (13) stopped at the empty bag supply position are provided separately from each other, so that the transfer of bags (transfer by a first clamp (45) and a second clamp (61)) is performed by such two different mechanisms (the reference numbers and letters given in parentheses above are those used in Patent Document 3). Accordingly, the bag supply device of Patent Document 3 has the same problem as that in the bag supply device of Patent Document 2.

BRIEF SUMMARY OF THE INVENTION

The present invention relates to an improvement in a bag supply device for delivering (or supplying) an empty bag that has been taken out of an empty bag magazine device to a pair of grippers when the empty bag magazine device is not directly across from the pair of grippers stopped at an empty bag supply position, and it is an object of the present invention to provide a bag supply device that does not need to perform a transfer of an empty bag midway (or during the delivery action) and that the structure is not as complicated as in the conventional devices.

More specifically, the bag supply device according to the present invention is used in a rotary bag-filling packaging machine that includes a plurality of pairs of intermittently rotating grippers and is disposed between an empty bag magazine device, which holds numerous empty bags, and a pair of grippers, which are stopped at an empty bag supply position. The bag supply device receives empty bags one at a time from the empty bag magazine device, conveyed the bag toward the pair of grippers stopped at the empty bag supply position, and converts the bag to a vertical orientation in the course of the conveyance, and then delivers the bag to the pair of grippers. The bag supply device of the present invention comprises:

- an empty-bag holding member capable of holding or releasing an empty bag,
- a reciprocating mechanism for reciprocating the empty-bag holding member between a receiving position where the empty-bag holding member receives the empty bag and a delivery position where the empty bag is delivered to the pair of grippers,
- a first turning mechanism that turns the empty-bag holding member around a first axis, which is parallel to the bag width direction of the empty-bag holding member, in conjunction with the operation of the reciprocating mechanism, and orients the holding face of the empty-bag holding member vertically in the delivery position, and
- a second turning mechanism that turns the empty-bag holding member around a second axis, which is parallel to the bag length direction of the empty-bag holding member, and causes the empty bag held by the empty-bag holding member in the delivery position to be directly across from the pair of grippers stopped in the empty bag supply position.

In the above-described bag supply device, the bag width direction of the empty-bag holding member means the direction of the width of an empty bag held by the empty-bag holding member, and the bag length direction of the empty-bag holding member means the direction of the width of an empty bag held by the empty-bag holding member.

In a preferred embodiment of the above-described bag supply device of the present invention, the empty-bag holding member is a pair of holding components which can be opened and closed and is disposed at one end of a support member, and a drive mechanism for opening and closing the pair of holding components is provided on the support member. The reciprocating mechanism moves the empty-bag holding member back and forth between the receiving position and the delivery position via the support member, the first turning mechanism turns the support member around the first axis, and the second turning mechanism turns the support member around the second axis.

Preferred embodiments of the various constituent elements (the reciprocating mechanism, the first turning mechanism, and the second turning mechanism) of the above-described bag supply device of the present invention will be given below.

The reciprocating mechanism comprises:

- a stationary frame that is installed on a base of the rotary bag-filling packaging machine,
- a shaft component that is horizontally rotatably supported on the stationary frame, is linked to a drive mechanism, and rotates reciprocally, and
- a swing arm that is fixed to the shaft component and swings within a vertical plane.

The first turning mechanism includes a first linking rod that links the other end of the support member to the stationary frame. This first turning mechanism does not have its own drive source, and operates in conjunction with the operation of the reciprocating mechanism (in other words, it is operated by the drive source of the reciprocating mechanism). The linked parts at both ends of the first linking rod have a self-alignment capability (with inclination of the rotational axis permitted).

The second turning mechanism may not have its own drive source (so that it operates in conjunction with the operation of the reciprocating mechanism, as in the first turning mechanism does), or it may have its own drive source (which is an air cylinder).

In the former case, the second turning mechanism is comprised of:

- a rotary element that is rotatably provided on the end of the swing arm and has its rotational axis parallel to the vertical plane,
- a bifurcated arm whose base is rotatably attached to the center part of the swing arm and has its rotational axis perpendicular to the vertical plane,
- a second linking rod that links one end of the bifurcated arm to the stationary frame, and
- a third linking rod that links the other end of the bifurcated arm to the rotary element.

The middle part of the support member is rotatably provided on the rotary element. Also, the linked parts at both ends of the third linking rod have a self-alignment capability.

In the latter case, the second turning mechanism is designed such that the air cylinder is linked to one end of the bifurcated arm instead of the second linking rod. The second turning mechanism uses the operation of the air cylinder (the extension and contraction of the piston rod) to turn the support member around the second axis.

The terms vertical, horizontal, perpendicular, and parallel used with reference to the present invention are not to be construed as being limited to their mathematically or physically strict meanings, and they encompass the concepts of substantially vertical, substantially horizontal, substantially perpendicular, and substantially parallel, to the extent that the essence of the invention is not impaired. The same applies to the other terms.

As seen from the above, in the bag supply device of the present invention, when the empty-bag holding member reciprocates between the receiving position and the delivery position under the operation of the reciprocating mechanism, the first turning mechanism turns the support member (and thus the empty-bag holding member) around the first axis, and also the second turning mechanism turns the support member (and thus the empty-bag holding member) around the second axis. When the first turning mechanism turns the support member (and the empty-bag holding member) around the first axis, this changes the holding face of the empty-bag holding member from a state of being horizontal or inclined at the receiving position to a state of being vertical at the delivery position, and thus the empty bag held by the empty-bag holding member is converted from a horizontal or inclined orientation to a vertical orientation. Also, when the second turning mechanism causes the support member (and the empty-bag holding member) to turn around the second axis, the empty bag held by the empty-bag holding member at the delivery position are located directly across from the pair of grippers stopped at the empty bag supply position. In other words, in the delivery position, the width direction of an empty bag is oriented perpendicular to the plane of symmetry of the pair of grippers (which is a vertical plane when the pair of grippers are disposed symmetrically in relation to that vertical plane), and the center in the width direction of the empty bag is located in the plane of symmetry.

As seen from the above, according to the bag supply device of the present invention, an empty bag received by the empty-bag holding member from the empty bag magazine is delivered directly to the pair of grippers by the empty-bag holding member (with no transfer made in the course of being conveyed). Because there is no transfer in the course of being conveyed as seen in the bag supply devices disclosed in Patent Documents 2 and 3, empty bags can be conveyed more efficiently (thus assuring a better productivity of the bag-filling packaging machine). Also, since there is no transfer in the course of conveyance of empty bags, such risks that the empty bags will be misaligned or not be received can be voided, and in addition the bag supply device as a whole can be further simplified.

Furthermore, when the second turning mechanism operates in conjunction with the operation of the reciprocating mechanism (which is that when it does not have its own drive source), since neither of the first and second turning mechanisms has an independent drive source, the structure of the bag supply device can be further simplified, and its cost is also reduced.

DETAILED DESCRIPTION OF THE INVENTION

A bag supply device according to the present invention will now be described below in detail with reference to FIGS. 1 to 7.

The bag supply device shown in FIGS. 1 to 4 will be described first.

Figure 1:
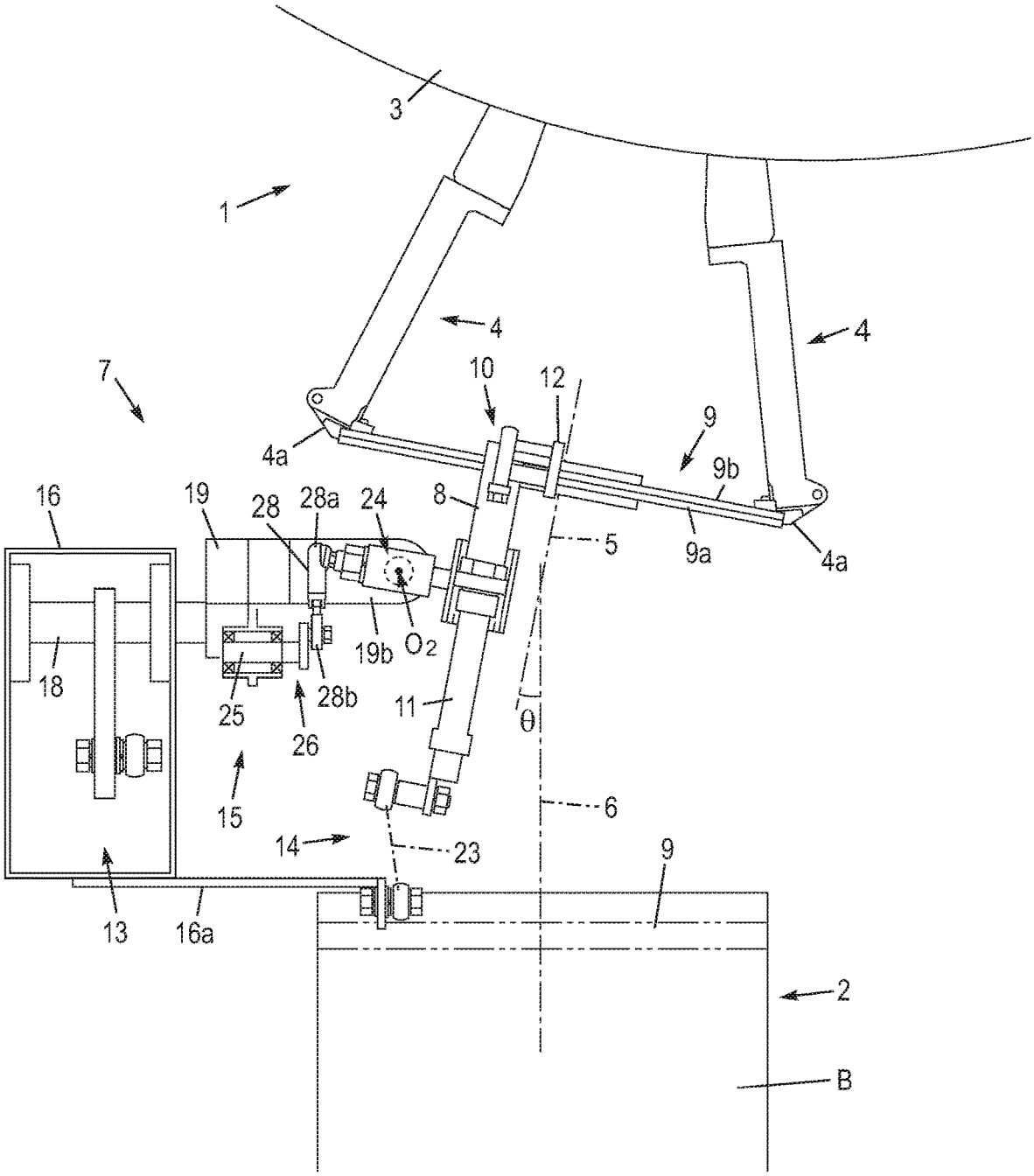
FIG. 1 is a top view of a bag supply device according to the present invention.

In FIG. 1, the reference numeral 1 refers to a rotary bag-filling packaging machine (only a part thereof illustrated), and 2 refers to a part of an empty bag magazine device.

The rotary bag-filling packaging machine 1 includes a plurality of pairs of grippers 4 installed at equal intervals around an intermittently rotating table 3. In this rotary bag-filling packaging machine 1, when the grippers 4 are stopped at the empty bag supply position (the positions shown in FIGS. 1 and 2), bags (empty bags) B are supplied one at a time by a bag supply device 7 (which will be described below) to gripping components 4*a* of the grippers 4. Then, as the table 3 (and the grippers 4) rotates intermittently, packaging steps, including opening of the mouth of the bag, filling of contents into the bag, sealing of the bag mouth, etc., are executed to the bag B that is gripped at its upper edges by the grippers 4 and is hanging down in a vertical orientation. These packaging steps are carried out sequentially, and then after which the gripping components 4*a* of the grippers 4 are opened to release the bag B (which is an finished product) from the grippers 4, and the bag is conveyed out of the machine.

As shown in FIG. 1, the empty-bag magazine device 2 is not directly across from the pair of grippers 4 stopped at the empty-bag supply position and is instead inclined at an angle θ. In other words, the plane of symmetry (a vertical plane) 5 of the grippers 4 and a vertical plane 6 that involves the center line that passes through the center in the width direction of the bags stored in the empty bag magazine device 2 intersect at the angle θ. The empty-bag magazine device 2 is a device that stores numerous empty bags and is, for example, of a type in which numerous bags are stacked and stored vertically in a horizontal orientation as disclosed in Patent Document 1, and it can be of a type, among others, as disclosed in Patent Document 2 (or in Japanese Patent Application Laid-Open (Kokai) No. 2014-999, etc.) in which numerous bags are stacked in such a form that the bag at the top of the stack is shifted forward and conveyed, the uppermost bag is separated and quickly fed out forward one at a time and positioned in a substantially horizontal orientation (a so-called conveyor magazine type of bag supply device).

As seen from FIG. 1, the bag supply device 7 is provided between the empty bag magazine device 2 and a pair of grippers 4 stopped at the empty bag supply position. The thus provided bag supply device 7 receives substantially horizontally orientated empty bags B one at a time from the empty bag magazine device 2, conveys the bag toward the pair of grippers 4, puts the bag B in a substantially vertical orientation, and delivers it to the pair of grippers.

The bag supply device 7 includes a support member 8, an empty-bag holding member 9 that is installed at one end (the right end in FIG. 2) of the support member 8 and is capable of holding or releasing an empty bags B, and a drive mechanism 10 for opening and closing the holding component (comprising a stationary holding component 9*a* and a movable holding component 9*b*) of the empty-bag holding member 9. The stationary holding component 9*a* is fixed to the support member 8. The drive mechanism 10 includes an air cylinder 11 (a drive source) and an arm 12 that is rotatably installed on the support member 8. The movable holding component 9*b* is installed at one end of the arm 12, and the distal end of the piston rod 11*a* of the air cylinder 11 is attached to the other end of the arm 12.

The bag supply device 7 comprises a reciprocating mechanism 13, a first turning mechanism 14, and a second turning mechanism 15, which will be described below. The reciprocating mechanism 13 and the first turning mechanism 14 have essentially the same structure as the mechanisms disclosed in Patent Document 1.

The reciprocating mechanism 13 moves the empty-bag holding member 9 back and forth between the receiving position (the position where the bag B is received from the empty-bag magazine device 2) and the delivery position (the position where the bag B is delivered to the grippers 4 stopped at the empty bag supply position), via the support member 8.

The reciprocating mechanism 13 comprises a stationary frame 16 installed on the base (not shown) of the rotary bag-filling and packaging machine 1, a shaft component 18 that is horizontally rotatably supported by the stationary frame 16, is linked to the drive mechanism 17, and rotates reciprocally, and a swing arm 19 that is fixed at its one end to the shaft component 18 and swings in a vertical plane. When the swing arm 19 swings, the support member 8 (and the empty-bag holding member 9) is moved between the upper advance position (the position indicated by the solid line) and the lower retraction position (the position indicated by the two-dot chain line) shown in FIG. 2. As shown in FIG. 3, the drive mechanism 17 includes a drive source such as a cam (not shown), a drive rod 21 that is linked to the drive source and moves up and down, and a drive arm 22 that is integrated with the shaft component 18 and is linked to the distal end of the drive rod 21.

The first turning mechanism 14 includes a first linking rod 23 that is rotatably linked at its both ends to the stationary frame 16 (the linking frame 16*a*) and the other end (the left end in FIG. 2) of the support member 8, respectively. The movement of the other end of the support member 8 is restricted by the first linking rod 23; accordingly, when the reciprocating mechanism 13 operates to swing the swing arm 19, and the support member 8 (and the empty-bag holding member 9) is moved, the support member 8 (and empty-bag holding member 9) turns around a first axis $O_1$ (will be described below). As seen from FIG. 2, when the support member 8 (and thus the empty-bag holding member 9) reaches the upper advance position (solid line position), the holding faces of the empty-bag holding member 9 (or of the holding components 9*a* and 9*b*) are oriented vertically, and when it reaches the lower retraction position (the position of the two-dot chain line) shown in FIG. 2, the holding faces are inclined nearly horizontally. The first linking rod 23 has rod ends 23*a* and 23*b* that have a self-alignment capability (with inclination of the rotational axis permitted) at its both ends, and it is linked to the stationary frame 16 (the linking frame 16*a*) and the other end of the support member 8 via the rod ends 23*a* and 23*b*.

The swing arm 19 has at its end a pair of support portions 19*a* and 19*b* extending in parallel with the shaft component 18, and the shaft 24*a* of a rotary element 24 is rotatably supported by the support portions 19*a* and 19*b*. The rotational axis of the shaft 24*a* of the rotary element 24 is what is called the second axis $O_2$ in the present invention (see FIGS. 1 and 3), and it is always parallel to the bag length direction of the empty-bag holding member 9 (see the arrow b in FIG. 3). A shaft 24*b* of the rotary element 24 protrudes perpendicular to the shaft 24*a* from a side face of the rotary element 24, and the support member 8 is rotatably supported with respect to the shaft 24*a* at its middle part in the lengthwise direction. The rotational axis of the support member 8 (which is the center of the shaft 24*b*) is what is called the first axis $O_1$ in the present invention (see FIGS. 2 and 3), and it is always parallel to the bag width direction of the empty-bag holding member 9 (see the arrow a in FIG. 3).

The second turning mechanism 15 includes the above-described rotary element 24, a bifurcated arm 26 whose base (the shaft 25) is rotatably attached to the middle part in the lengthwise direction of the swing arm 19 and in which the rotational axis of the shaft 25 is perpendicular to the vertical plane (the plane along which the swing arm 19 swings), a second linking rod 27 that is rotatably linked at both ends to the stationary frame 16 (linking frame 16*b*) and one end 26*a* of the bifurcated arm 26, and a third linking rod 28 that is rotatably linked to the other end 26*b* of the bifurcated arm 26 and the rotary element 24 (the opposite side from the shaft 24*b*). The rotational center of the linked parts formed by the second linking rod 27 and the linking frame 16*b* is a specific distance away from the swing center of the swing arm 19 (the rotational axis of the shaft component 18) as seen from FIGS. 2 and 3. Therefore, when the reciprocating mechanism 13 operates to swing the swing arm 19, the bifurcated arm 26 linked to the second linking rod 27 rotates (swings around the shaft 25), and the rotary element 24 rotates around the second axis $O_2$ via the third linking rod 28, which is accompanied by the turning of the support member 8 (and the empty-bag holding member 9) around the second axis $O_2$. The third linking rod 28 has at its both ends rod ends 28*a* and 28*b* that have a self-alignment capability (with inclination of the rotational axis permitted), and it is linked to the rotary element 24 and the end 26*b* of the bifurcated arm 26 via these rod ends 28*a* and 28*b*.

Next, the overall operation of the above-described bag supply device 7 will be described below in time sequence.

Figure 2:
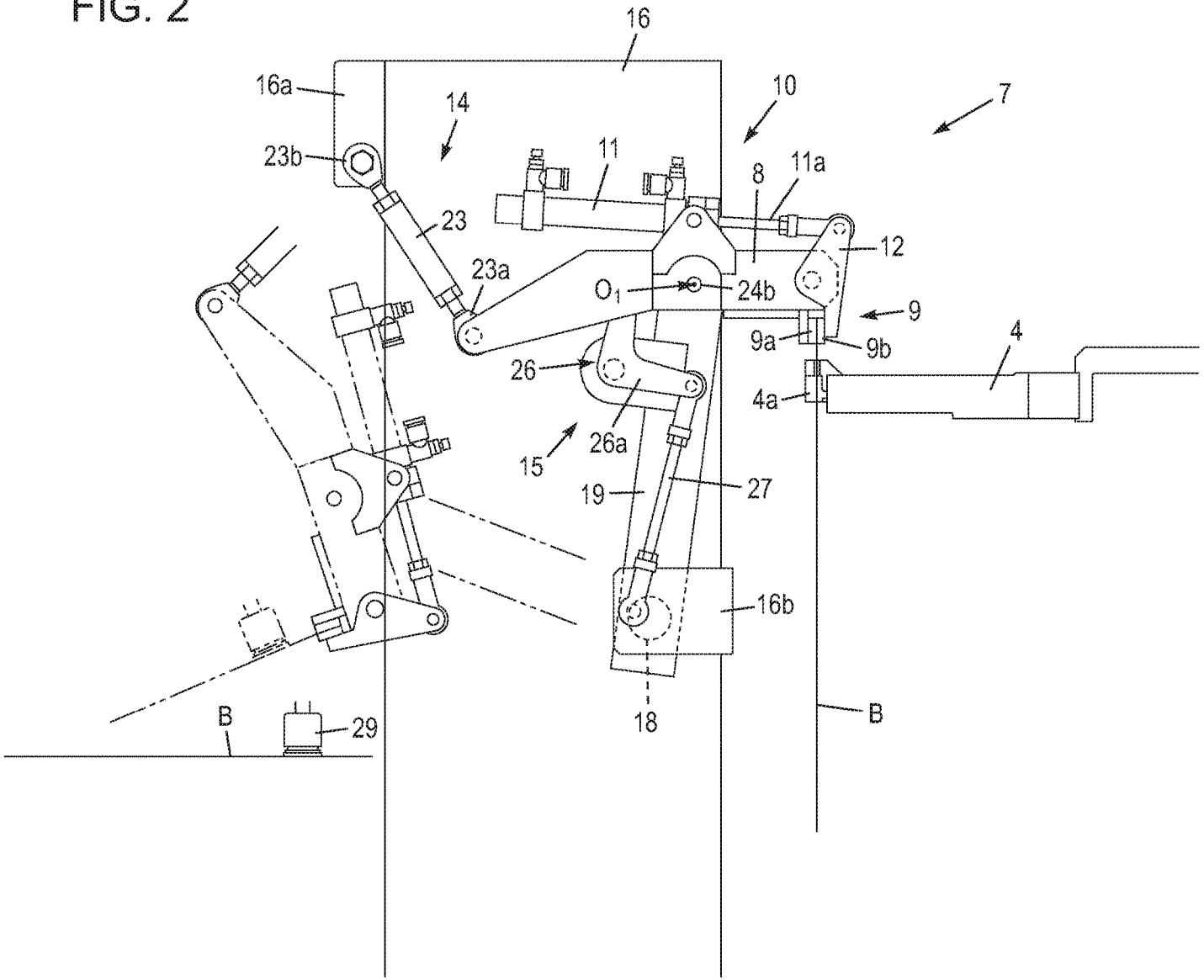
FIG. 2 is a side view of the bag supply device shown in FIG. 1.
Figure 3:
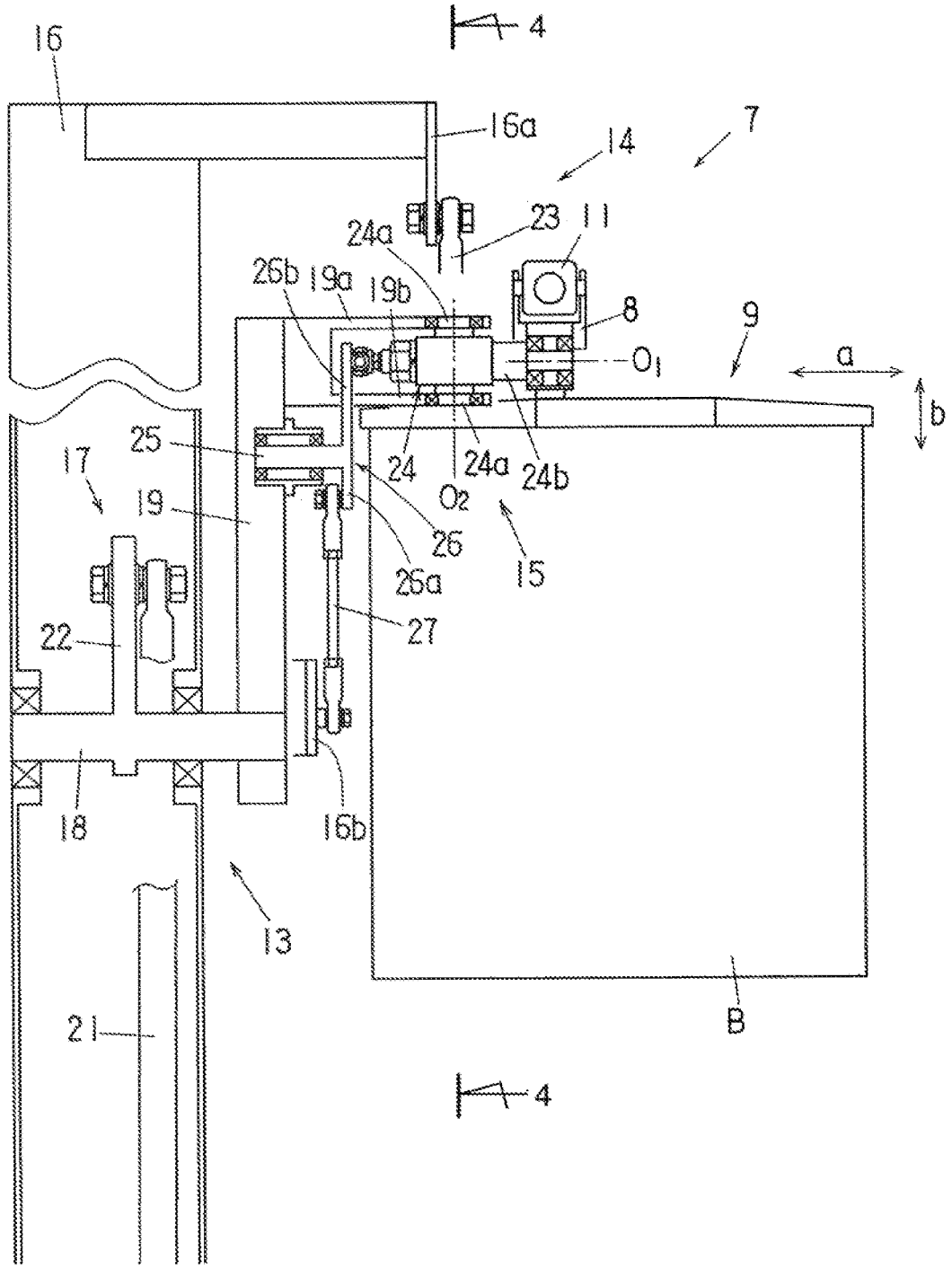
FIG. 3 is a front cross-sectional view of the bag supply device shown in FIG. 1.
Figure 4:
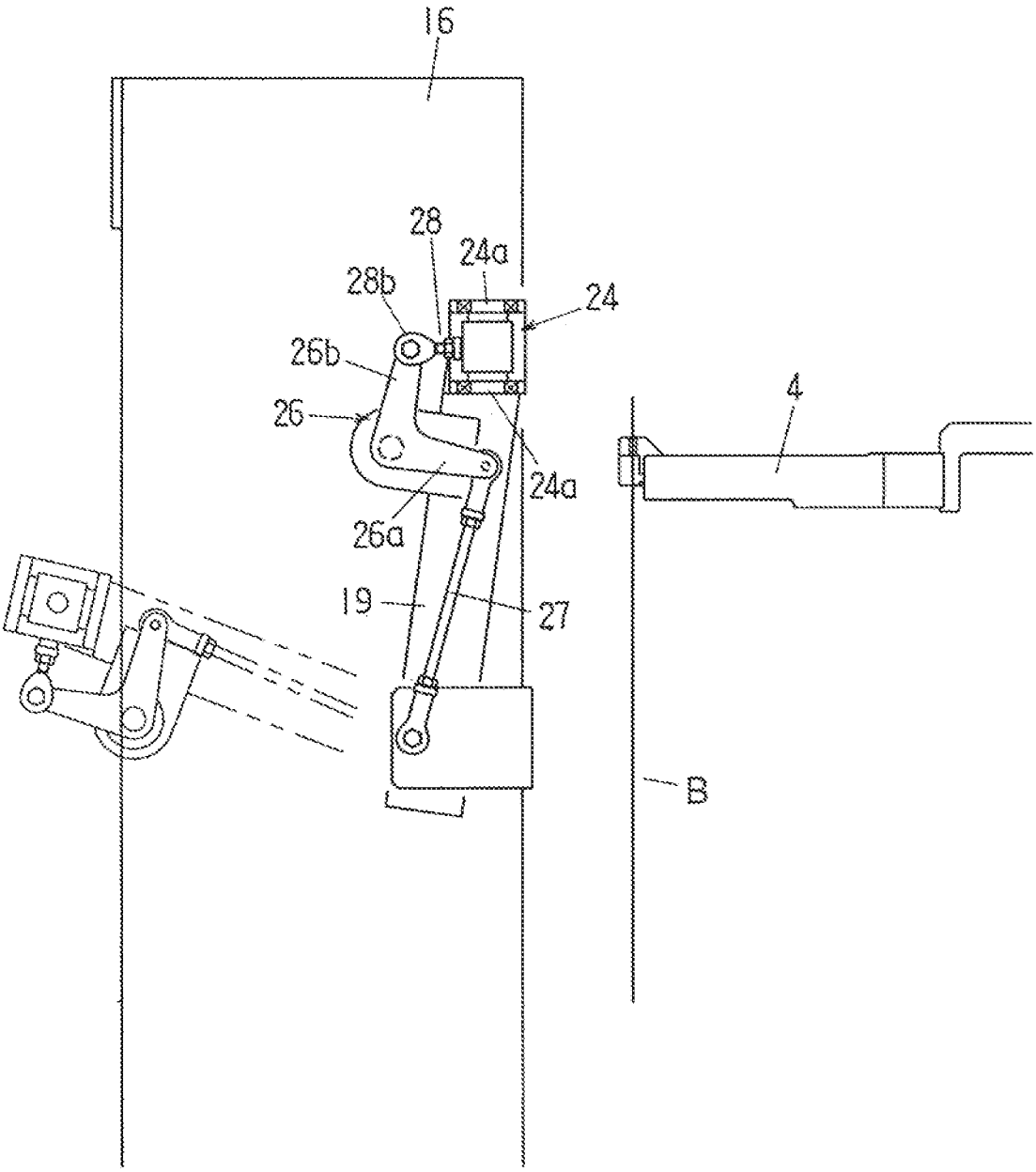
FIG. 4 is a cross section view taken along the lines 4-4 in FIG. 3.

(1) As shown in FIG. 2, the uppermost empty bag B out of the numerous empty bags stored in the empty bag magazine device 2 is picked up by an ascending and descending suction cup 29 of a bag take-out device (see FIG. 2) and lifted upward.

(2) The swing arm 19 swings rearward (or swings toward the empty bag magazine device 2), and as shown by the two-dot chain line in FIGS. 1 and 2, the support member 8 faces downward upon reaching the lower retracted position, and the empty-bag holding member 9 reaches the receiving position. At this point, the empty-bag holding member 9 is inclined nearly horizontally (with its inclination angle substantially coincide with the inclination angle of the bag B lifted up by the suction cup 29), and its bag width direction is parallel to the width direction of the empty bag B. The holding components (the stationary holding component 9*a* and the movable holding component 9*b*) of the empty-bag holding member 9 are open at this point, and the mouth-side distal end of the bag B lifted up by the suction cup 29 enters between the holding components 9*a* and 9*b*.

The air cylinder 11 is then actuated, the holding components 9*a* and 9*b* of the empty-bag holding member 9 are closed, and the bag B is held by the empty-bag holding member 9. At this point, the empty bag B held by the empty-bag holding member 9 is not directly across from the pair of grippers 4 and 4 stopped at the empty bag supply position.

(3) The swing arm 19 is then swung forward (or swung toward the empty bag supply position where the pair of grippers 4 are stopped), causing the support member 8 to move to the above-described upper advance position; and thus, the empty-bag holding member 9 is moved from the receiving position toward the delivery position. In the course of this movement of the empty-bag holding member 9, the first and second turning mechanisms 14 and 15 are actuated, and the support member 8 (and the empty-bag holding member 9) turns around the first axis $O_1$ and the second axis $O_2$.

(4) Before the empty-bag holding member 9 reaches the delivery position, the grippers 4 stop at the empty bag supply position. At this point, the gripping components 4*a* of the grippers 4 are open.

(5) When the support member 8 reaches the upper advance position and becomes substantially horizontal, and the empty-bag holding member 9 reaches the delivery position, as shown by the solid line in FIGS. 1 and 2, the bag width direction of the empty-bag holding member 9 (and the width direction of the bag B held by the empty-bag holding member 9) becomes horizontal, the bag length direction of the empty-bag holding member 9 becomes vertical, and the bag B goes into a vertical orientation, and further the width direction center of the bag B is located within the plane of symmetry 5. In other words, at this point, the empty bag B held by the empty-bag holding member 9 is in a state of being directly across from the grippers 4.

After the empty-bag holding member 9 has reached the delivery position, the grippers 4 are closed to grip the upper edges of the empty bag B, the air cylinder 11 then operates in reverse to open the empty-bag holding member 9, so that the empty bag B is released from the empty-bag holding member 9.

Figure 6:
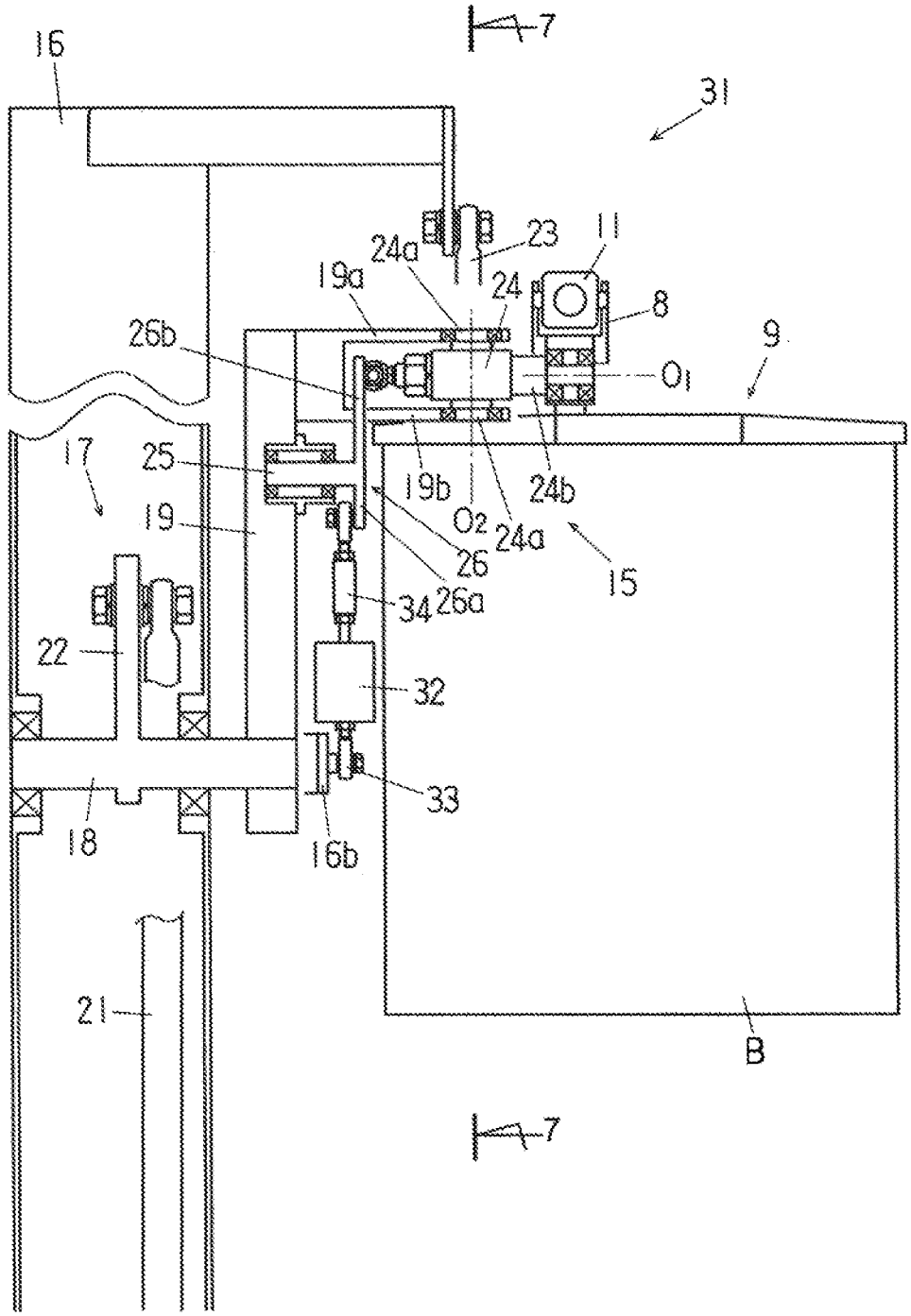
FIG. 6 is a front cross-sectional view of the bag supply device shown in FIG. 5.
Figure 7:
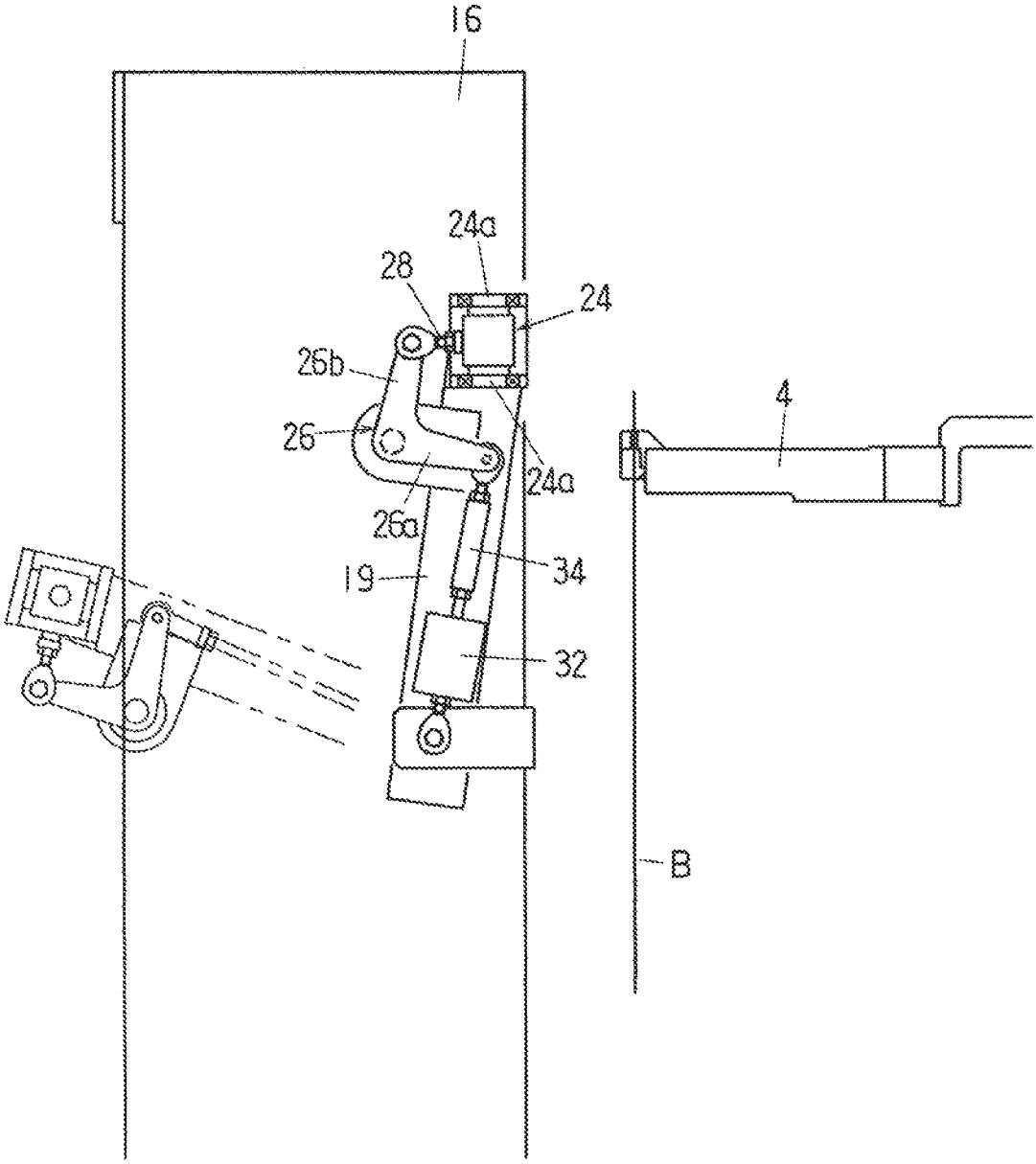
FIG. 7 is a cross-sectional view taken along the lines 7-7 in FIG. 6.

Next, the bag supply device 31 shown in FIGS. 5 to 7 will be described. The top view of the bag supply device 31 can be referred to FIG. 1. Components that are substantially the same as those of the bag supply device 7 of FIGS. 1 to 4 are numbered the same in FIGS. 5 to 7.

The bag supply device 31 differs from the bag supply device 7 in that an air cylinder 32 is linked, as a drive source for the second turning mechanism 15, to one end 26*a* of the bifurcated arm 26. All other respects are the same as the bag supply device 7.

In the bag supply device 31, the rear end of the air cylinder 32 is linked to the connecting frame 16*b* via a rod end 33, one end of a linking rod 34 is linked to the distal end of the piston rod 32*a* of the air cylinder 32, and the other end of the linking rod 34 is linked to one end 26*a* of the bifurcated arm 26 via a rod end 35. The rotational center of the linked parts of the air cylinder 32 and the linking frame 16*b* (the center of rotation of the rod end 33) coincides with the rotational center of the swing arm 19 (the rotational axis of the shaft component 18). Therefore, in the second turning mechanism 15 of the bag supply device 31, even if the reciprocating mechanism 13 operates (or even if the swing arm 19 swings), the bifurcated arm 26 is not rotated; and the operation of the air cylinder 32 (extension and contraction of the piston rod 32*a*) causes the bifurcated arm 26 to rotate, so that the support member 8 (and the empty-bag holding member 9) is turned around the second axis $O_2$.

The rod end 33 does not necessarily have to be linked to the connecting frame 16*b*, and it can instead be linked to the end of the shaft component 18.

Next, the operation of the bag supply device 31 will be described briefly, focusing mainly on the operation of the air cylinder 32.

Figure 5:
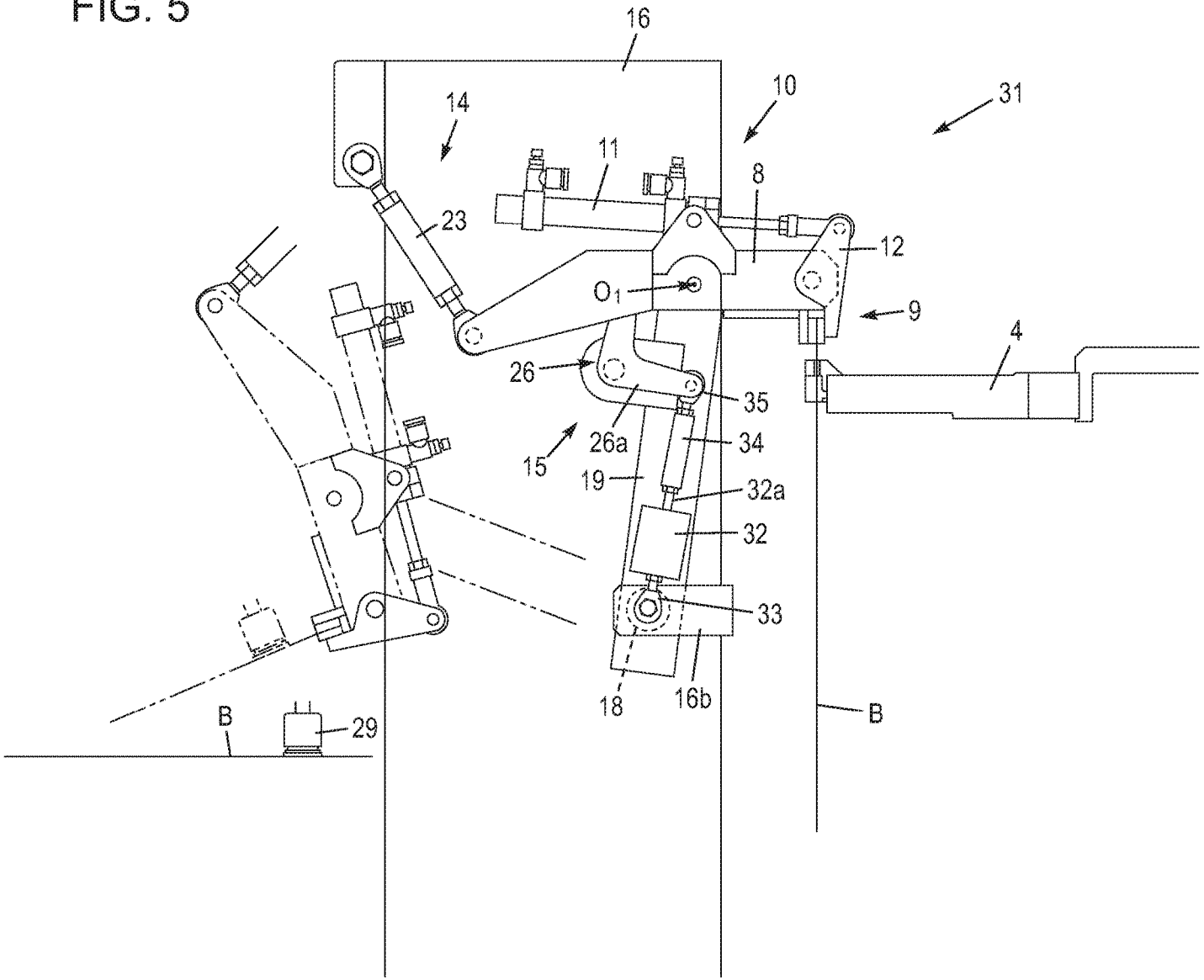
FIG. 5 is a side view of another bag supply device according to the present invention.

The swing arm 19 swings rearward (or swings toward the empty-bag magazine device 2), and as indicated by the two-dot chain line in FIG. 5 (see FIG. 1 also), when the support member 8 faces down upon reaching the lower retraction position, and the empty-bag holding member 9 reaches the receiving position, the empty-bag holding member 9 is inclined close to horizontal. At this point, the piston rod 32*a* of the air cylinder 32 is extended, and the bag width direction of the empty-bag holding member 9 is parallel to the width direction of the empty bag B.

When the swing arm 19 swings forward (or swings toward the empty bag supply position where the pair of grippers 4 is stopped), the support member 8 is moved to the upper advance position, which causes the empty-bag holding member 9 to move from the receiving position toward the delivery position. In the course of this movement of the empty-bag holding member 9, the first turning mechanism 14 is actuated, and the support member 8 (and the empty-bag holding member 9) is turned around the first axis $O_1$. At the same time, the air cylinder 32 is actuated to contract the piston rod 32*a*, which actuates the second turning mechanism 15 and causes the support member 8 (and the empty-bag holding member 9) to turn around the second axis $O_2$.

When the support member 8 becomes substantially horizontal upon reaching the upper advance position, and the empty-bag holding member 9 is in the delivery position, as shown by the solid line in FIG. 5 (see FIG. 1 also), the bag width direction of the empty-bag holding member 9 (and the width direction of the bag B held by the empty-bag holding member 9) is horizontal, the bag length direction of the empty-bag holding member 9 is vertical, the bag B is in a vertical orientation, and the width direction center of the bag B is located in the plane of symmetry 5. In other words, at this point, the empty bag B held by the empty-bag holding member 9 is in a state of being directly across from the grippers 4.

The invention claimed is:

1. A bag supply device, used in a rotary bag-filling packaging machine which is equipped with a plurality of pairs of intermittently rotating grippers, said bag supply device disposed between a pair of grippers stopped at an empty bag supply position and an empty bag magazine device configured to hold empty bags, and said bag supply device receives empty bags one at a time from the empty bag magazine device, conveys an empty bag toward the pair of grippers stopped at the empty bag supply position, and converts the bag from a horizontal or incline orientation to a substantially vertical orientation in a course of the conveyance to deliver the bag to the pair of grippers;

wherein said bag supply device comprises:

an empty-bag holding member for holding or releasing an empty bag, a reciprocating mechanism for reciprocating the empty-bag holding member between a receiving position where the empty-bag holding member receives the empty bag and a delivery position where the empty bag is delivered to the pair of grippers, a first turning mechanism configured to turn the empty-bag holding member around a first axis in conjunction with an operation of the reciprocating mechanism and to orient a holding face of the empty-bag holding member vertically in the delivery position, the first axis associated with a bag width direction of the empty-bag holding member, and a second turning mechanism configured to turn the empty-bag holding member around a second axis and to cause the empty bag held by the empty-bag holding member in the delivery position to be directly across from the pair of grippers stopped in the empty bag supply position, the second axis different from the first axis, and the second axis associated with a bag length direction of the empty-bag holding member.

2. The bag supply device according to claim 1, wherein:

said empty-bag holding member is comprised of a pair of holding components which can be opened and closed and is disposed at one end of a support member, said support member is provided with a drive mechanism for opening and closing the pair of holding components, said reciprocating mechanism moves the empty-bag holding member back and forth between the receiving position and the delivery position via the support member, said first turning mechanism turns the support member around the first axis, and said second turning mechanism turns the support member around the second axis.

3. The bag supply device according to claim 2, wherein:

said second turning mechanism is configured to turn the support member around the second axis in conjunction with the operation of the reciprocating mechanism.

4. The bag supply device according to claim 3, wherein:

said reciprocating mechanism comprises:

a stationary frame installed on a base of the rotary bag-filling packaging machine, a shaft component horizontally rotatably supported on the stationary frame and linked to a drive mechanism to rotate reciprocally, and a swing arm fixed to the shaft component and swings within a vertical plane;

said first turning mechanism comprises a first linking rod that links the other end of the support member to the stationary frame, linked parts at both ends of the first linking rod having a self-alignment capability;

said second turning mechanism comprises:

a rotary element rotatably provided on an end of the swing arm with a rotational axis thereof parallel to the vertical plane, a bifurcated arm rotatably attached at a base thereof to a center part of the swing arm with a rotational axis thereof perpendicular to the vertical plane, a second linking rod linking one end of the bifurcated arm to the stationary frame, and a third linking rod linking another end of the bifurcated arm to the rotary element, linked parts at both ends of the third linking rod having a self-alignment capability; and said support member is, at a middle part thereof, rotatably attached to the rotary element.

5. The bag supply device according to claim 2, wherein:

said second turning mechanism is provided with an air cylinder as a drive source thereof, thus turning the support member around the second axis by an operation of the air cylinder.

6. The bag supply device according to claim 5, wherein:

said reciprocating mechanism comprises:

a stationary frame installed on a base of the rotary bag-filling packaging machine, a shaft component horizontally rotatably supported on the stationary frame and linked to a drive mechanism to rotate reciprocally, and a swing arm fixed to the shaft component and swings within a vertical plane;

said first turning mechanism comprises a first linking rod that links the other end of the support member to the stationary frame, linked parts at both ends of the first linking rod having a self-alignment capability;

said second turning mechanism comprises:

a rotary element rotatably provided on an end of the swing arm with a rotational axis thereof parallel to the vertical plane, a bifurcated arm rotatably attached at a base thereof to a center part of the swing arm with a rotational axis thereof perpendicular to the vertical plane, the air cylinder linked to one end of the bifurcated arm, and a third linking rod that links another end of the bifurcated arm to the rotary element, linked parts at both ends of the third linking rod having a self-alignment capability; and said support member is, at a middle part thereof, rotatably attached to the rotary element.

7. The bag supply device according to claim 1, wherein, when the empty-bag holding member is at the delivery position:

the first axis is substantially horizontal; and the second axis is substantially vertical.

8. The bag supply device according to claim 1, wherein:

the first axis is parallel to the bag width direction of the empty-bag holding member; and the second axis parallel to the bag length direction of the empty-bag holding member.

9. The bag supply device according to claim 1, wherein the bag supply device converts the bag from a substantially horizontal orientation to the substantially vertical orientation in a course of the conveyance to deliver the bag to the pair of grippers.

* * * * *